US012751559B1

(12) United States Patent
Lin

(10) Patent No.: US 12,751,559 B1
(45) Date of Patent: Oct. 6, 2026

(54) INFLATABLE MATTRESS STRUCTURE

(71) Applicant: FENG YI OUTDOOR LEISURE EQUIPMENT ENTERPRISE CO., LTD, Taichung City (TW)

(72) Inventor: Ping Ting Lin, Taichung City (TW)

(73) Assignee: FENG YI OUTDOOR LEISURE EQUIPMENT ENTERPRISE CO., LTD, Taichung City (TW)

( * ) Notice: Subject to any disclaimer, the term of this patent is extended or adjusted under 35 U.S.C. 154(b) by 0 days.

(21) Appl. No.: 19/201,225

(22) Filed: May 7, 2025

(51) Int. Cl.
*A47C 27/08* (2006.01)
*A47C 27/12* (2006.01)

(52) U.S. Cl.
CPC ..... *A47C 27/087* (2013.01); *A47C 27/128* (2013.01)

(58) Field of Classification Search
CPC ..... A47C 27/00; A47C 27/08; A47C 27/087; A47C 27/128
See application file for complete search history.

(56) References Cited

U.S. PATENT DOCUMENTS 3,206,776 A * 9/1965 Terris ..... A47C 27/081 5/709
2012/0042981 A1* 2/2012 Ray ..... F24F 13/0263 428/215
2021/0186225 A1* 6/2021 Maxfield ..... A47C 27/18

* cited by examiner

*Primary Examiner* — Fredrick C Conley
(74) *Attorney, Agent, or Firm* — MUNCY, GEISSLER, OLDS & LOWE, P.C.

(57) ABSTRACT

An inflatable mattress structure with improved thermal insulation is disclosed. The structure includes upper and lower layers coated with adhesive and airtight thermoplastic polyurethane (TPU) film and sealed along their peripheries. A plurality of parallel internal baffles is disposed between the layers to define parallel and interconnected air channels. A thermal insulation material, comprising a polyethylene terephthalate (PET) film laminated with a synthetic cotton and coated with an electroplated aluminum film, is positioned above and below within each air channel to enhance thermal radiation reflection. The upper surface of the synthetic cotton is thermally fused to the TPU films to form two fused segments spaced equal to or slightly less than the maximum width of the insulation material, thereby maintaining flatness during inflation and storage.

9 Claims, 12 Drawing Sheets

INFLATABLE MATTRESS STRUCTURE

FIELD OF INVENTION

The present invention relates to an inflatable mattress structure, and more particularly to an inflatable mattress structure with improved thermal insulation performance.

BACKGROUND OF THE INVENTION

Conventional inflatable mattresses are widely used in outdoor environments, such as mountaineering and camping, and are designed to be deflatable and inflatable to facilitate portability and user convenience. As shown in FIGS. 1 to 4, a conventional inflatable mattress 10 comprises an upper layer 11 and a lower layer 12, each internally coated with a thermoplastic polyurethane (TPU) film that is adhesive and impermeable to air. The upper and lower layers 11 and 12 are sealed along their peripheries by a thermal fusion. A plurality of internal baffles 13, formed from TPU or other polymeric materials, is thermally bonded between the upper layer 11 and the lower layer 12 with two ends of the internal baffles 13. The internal baffles 13 are arranged in parallel, thereby defining a plurality of parallel and interconnected air channels 14 between the upper and lower layers 11 and 12. A thermal insulation material 15 is disposed above and below within each of the air channels 14. The thermal insulation material 15 comprises an aluminum film 151 laminated with a synthetic cotton 152 on its upper surface. The upper and lower aluminum films 151 are arranged facing the interior of the air channel 14 such that opposing reflective surfaces face each other, creating a refractive effect that can enhance the reflection of thermal radiation and improves the heat retention performance of the inflatable mattress 10. In addition, an upper surface of the synthetic cotton 152 is thermally fused to the TPU films of the upper and lower layers 11 and 12 to form a fused segment 16 in each layer.

When air is introduced into the inflatable mattress 10 via an air valve 17, the air flows through the air channels 14 and inflates the mattress, forming an inflatable support layer. The thermal insulation material 15, secured by the fused segments 16, moves in unison with displacement of the upper and lower layers 11, 12, thereby providing cushioning elasticity and thermal insulation suitable for outdoor applications.

However, in the conventional configuration, the thermal insulation material 15, comprising the aluminum film 151 and the laminated synthetic cotton 152, is secured only at a central portion via the fused segments 16. To prevent interference during the fusion process, the fused segments 16 are typically positioned between adjacent internal baffles 13, since the internal baffles 13, being formed from thermoplastic materials, are susceptible to melting under high temperatures. Consequently, the central portion of the thermal insulation material 15 is secured in position, while opposing free edges 153 and 154 remain unsecured. During inflation or displacement of the upper and lower layers 11, 12, the free edges 153 and 154 of the thermal insulation material 15 may deflect inward into the air channels 14. This inward bending allows air to circulate into the space between the free edges 153, 154 and the respective upper and lower layers 11, 12, thereby compromising the uniformity of inflation and preventing the thermal insulation material 15 from remaining flat.

Furthermore, when the inflatable mattress 10 is deflated and folded for storage, the unsecured free edges 153, 154 may again bend inward, making it difficult for the thermal insulation material 15 to remain flat. As a result, during subsequent inflation, the thermal insulation material 15 may fail to fully expand, thereby impairing the thermal insulation effect and the structural integrity of the inflatable mattress 10.

SUMMARY OF THE INVENTION

The primary objective of the present invention is to provide an inflatable mattress structure capable of ensuring that a thermal insulation material remains flat and securely positioned during both inflation and storage. This can be achieved by forming two fused segments between an upper surface of a synthetic cotton of the thermal insulation material and an upper and lower layer, respectively. Meanwhile, a maximum edge-to-edge distance between the two fused segments on each of the upper and lower layers should be equal to or slightly less than a maximum width of the free edges of the thermal insulation material to prevent inward folding or displacement of the insulation during use or storage.

To achieve the foregoing objective, the inflatable mattress structure comprises an upper layer and a lower layer, each coated internally with a thermoplastic polyurethane (TPU) film that is adhesive and airtight, and sealed along their peripheral edges by thermal fusion. A plurality of internal baffles is thermally bonded between the upper and lower layers and arranged in parallel, thereby defining a series of parallel and interconnected air channels. A thermal insulation material is disposed above and below within each of the air channels. The thermal insulation material comprises a polyethylene terephthalate (PET) film laminated with a synthetic cotton and coated with an electroplated aluminum film. The upper and lower aluminum-coated PET layers are arranged facing the interior of the air channels, creating a radiant refraction effect between them that can enhance the reflection of thermal radiation. The upper surface of the synthetic cotton is thermally fused to the TPU film of each of the upper and lower layers to form two fused segments per layer, with the fused segments arranged in parallel with the internal baffles. A maximum edge-to-edge distance between the two fused segments is configured to be equal to or slightly less than the maximum width of the free edges of the thermal insulation material.

DETAILED DESCRIPTION OF THE PREFERRED EMBODIMENTS

Figure 1:
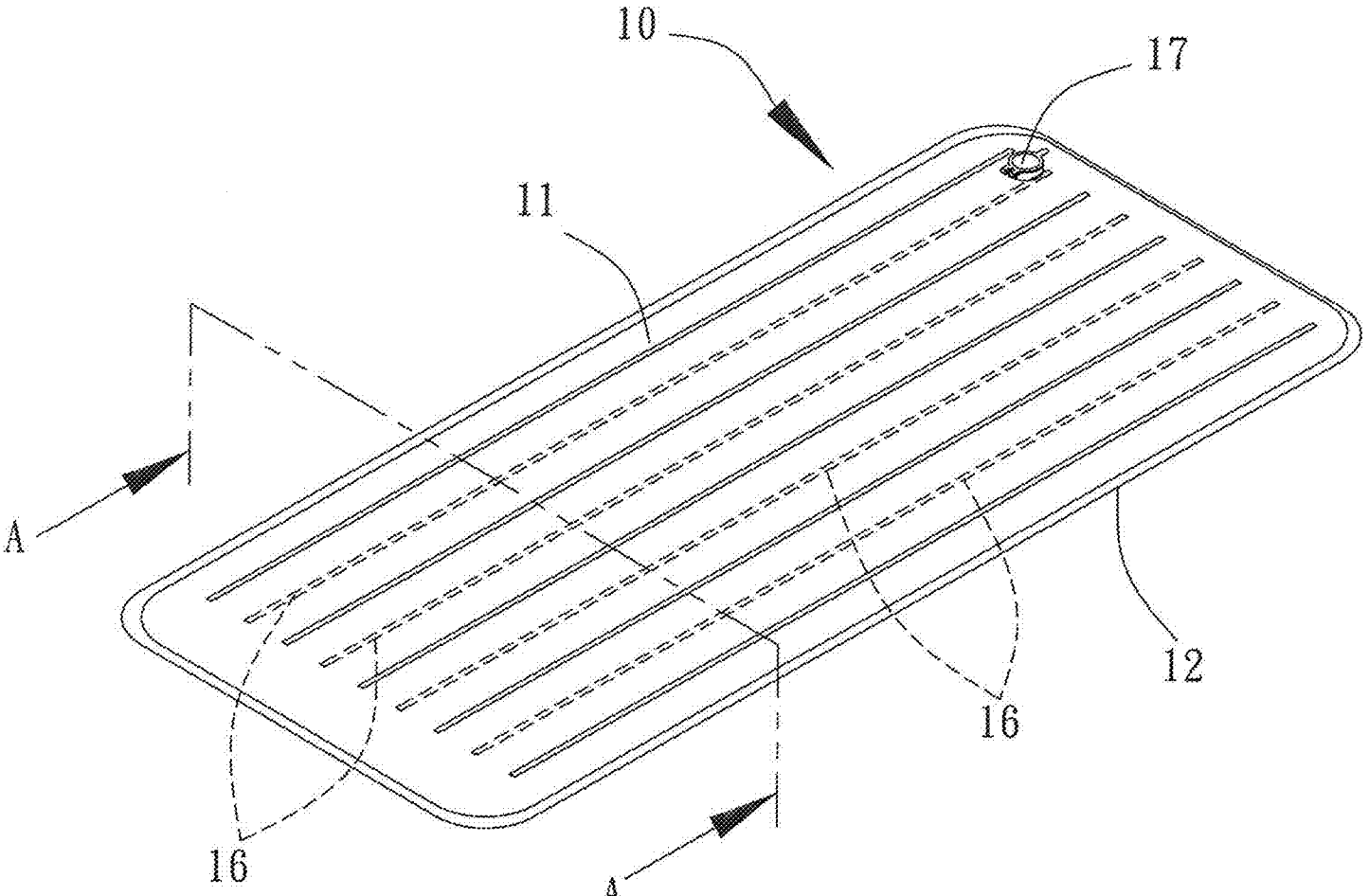
FIG. 1 PRIOR ART
FIG. 1 is a perspective view of a conventional inflatable mattress.
Figure 2:
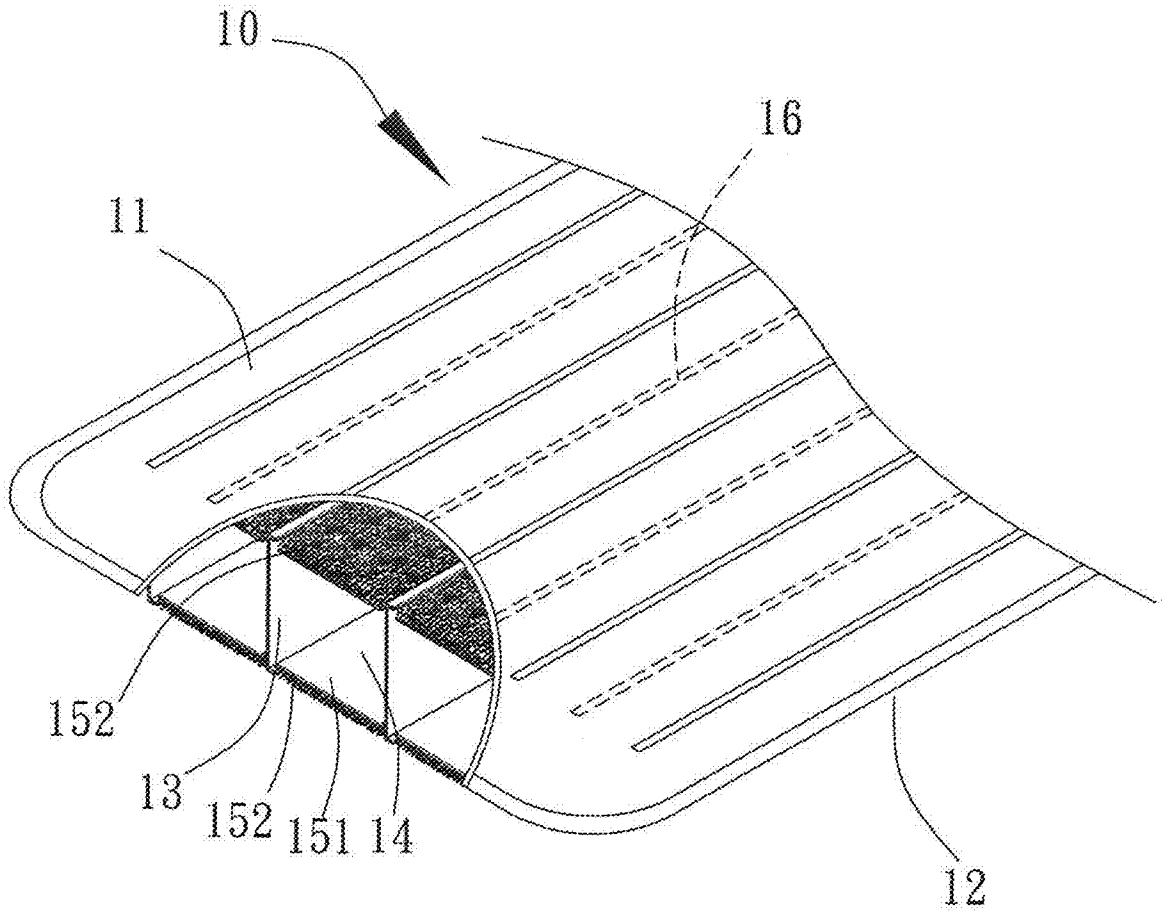
FIG. 2 PRIOR ART
FIG. 2 is a partial cross-sectional perspective view of the conventional inflatable mattress.
Figure 3:
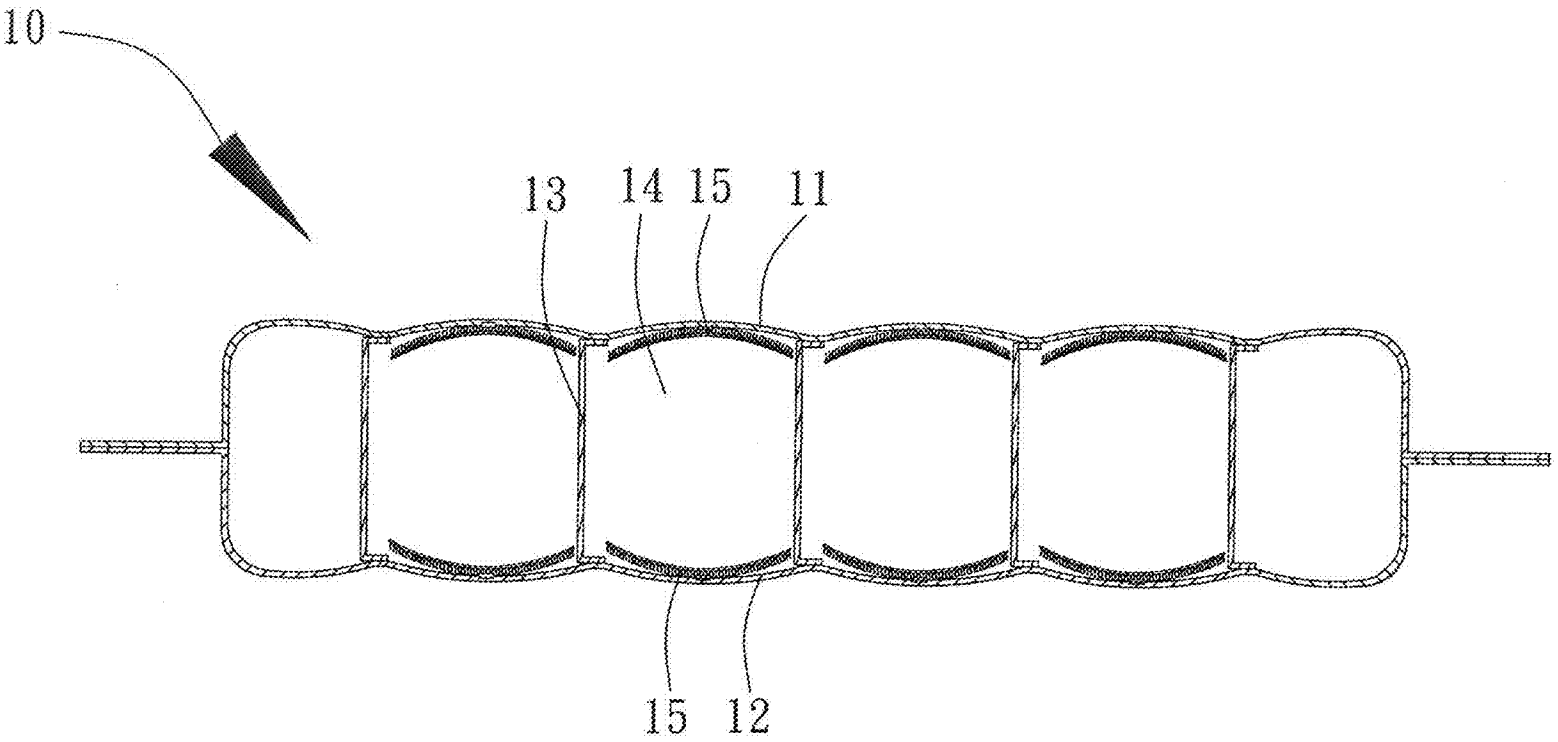
FIG. 3 PRIOR ART
FIG. 3 is a cross-sectional view along line A-A of FIG. 1.
Figure 4:
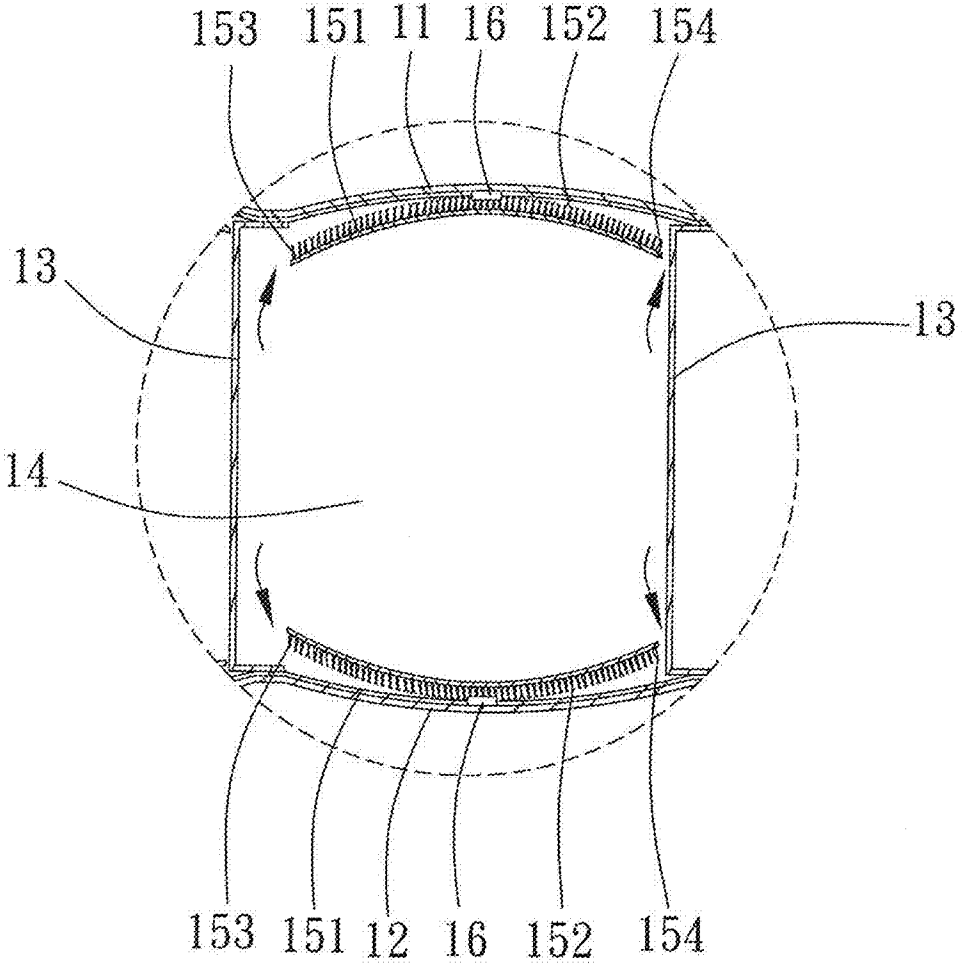
FIG. 4 PRIOR ART
FIG. 4 is an enlarged partial view of FIG. 3.
Figure 5:
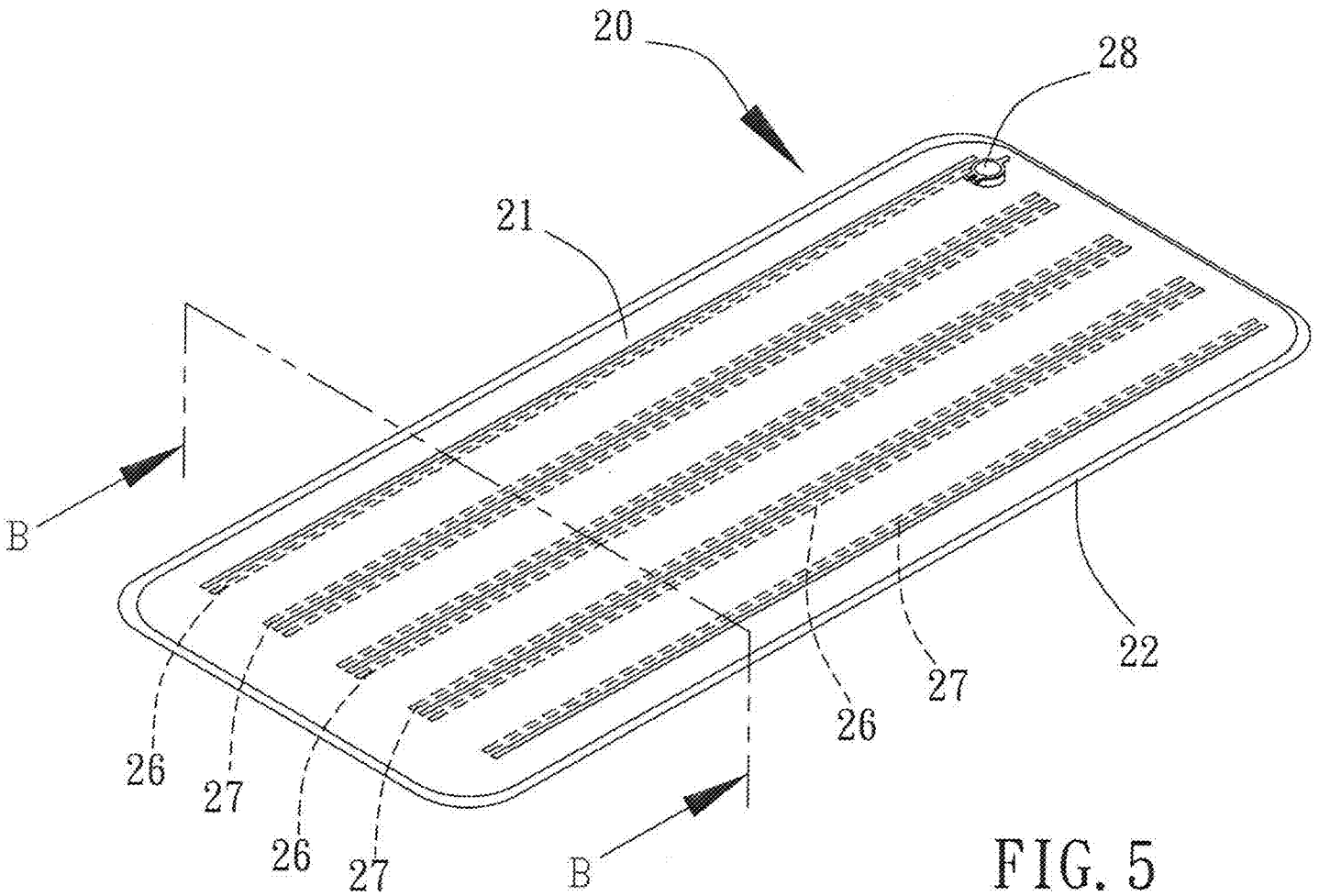
FIG. 5 is a perspective view of the inflatable mattress of the present disclosure.
Figure 6:
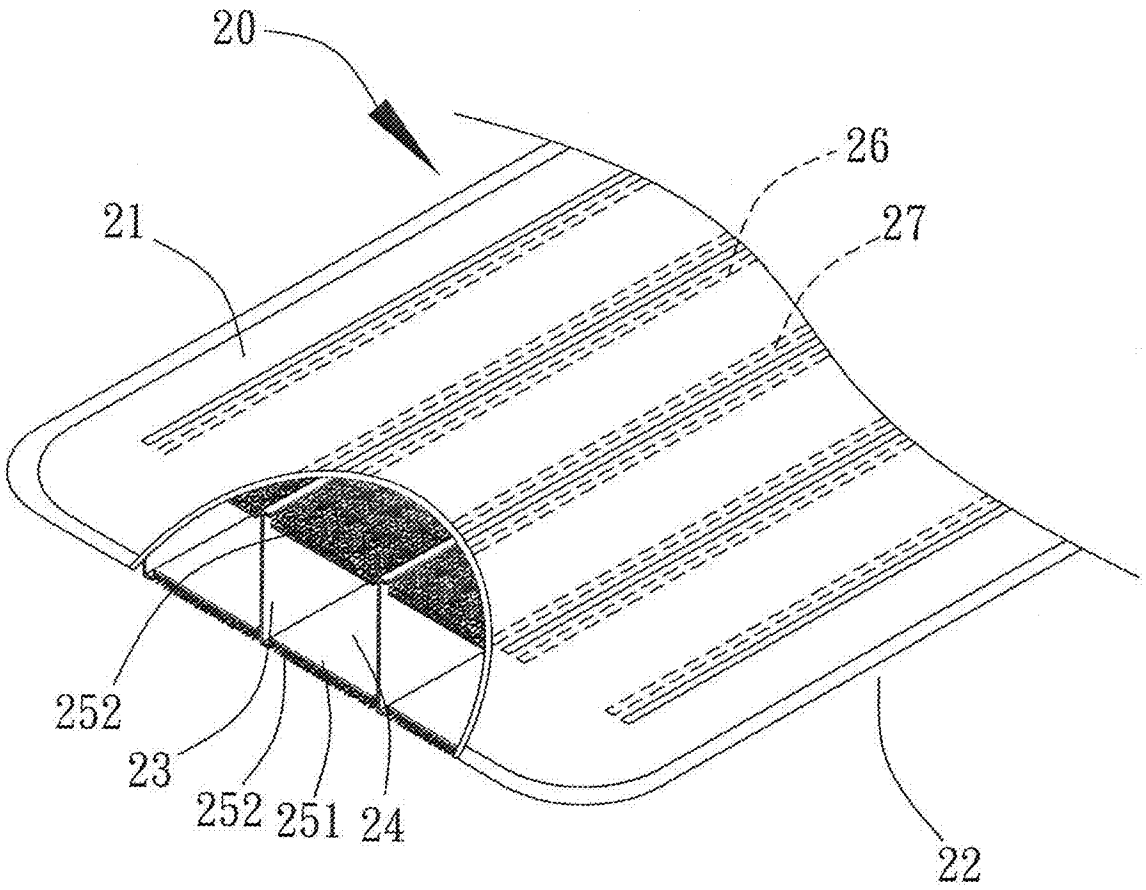
FIG. 6 is a partial cross-sectional perspective view of the present disclosure.
Figure 7:
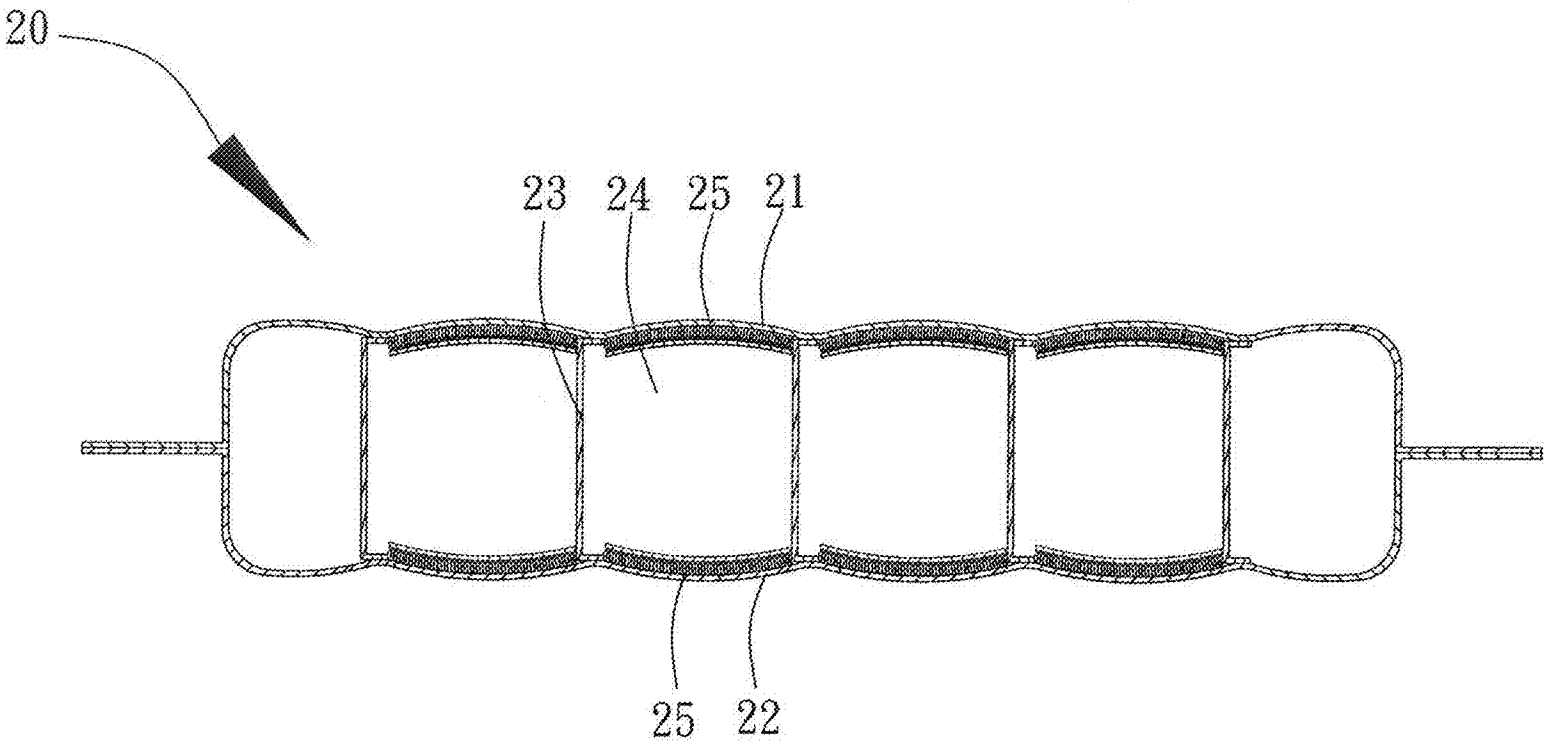
FIG. 7 is a cross-sectional view along line B-B of FIG. 5.
Figure 8:
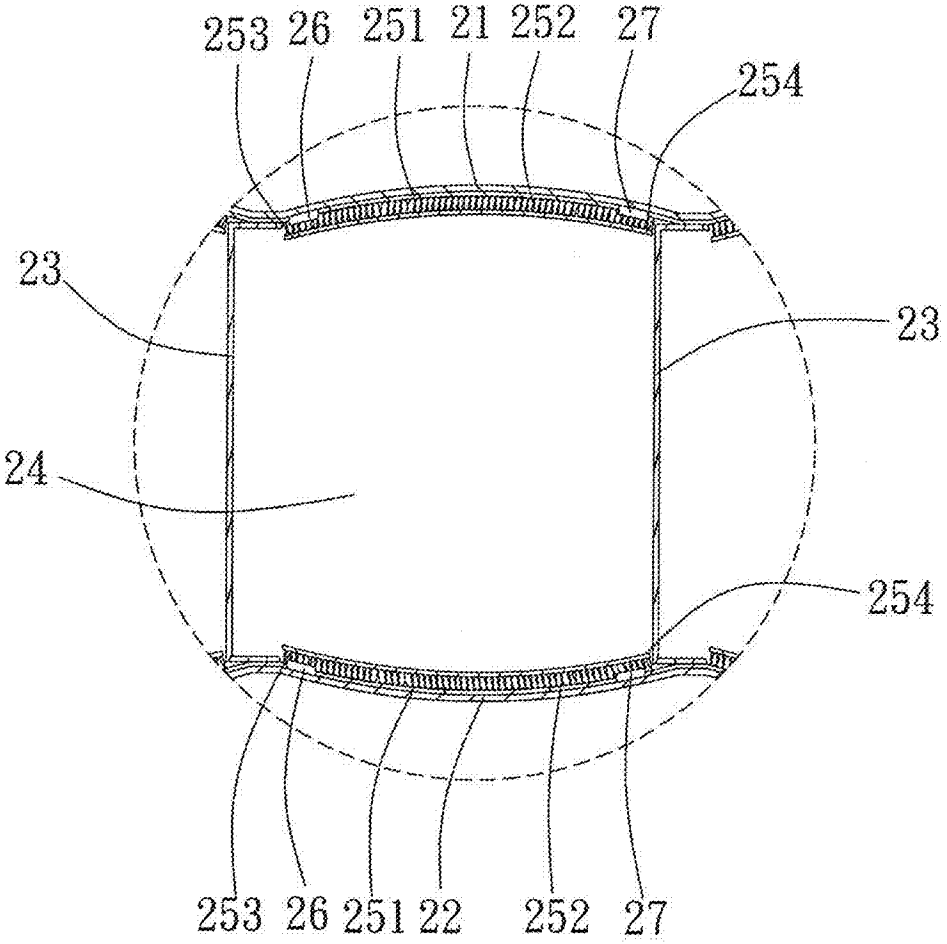
FIG. 8 is an enlarged partial view of FIG. 7.

Referring to FIGS. 5 to 8, an inflatable mattress 20 according to a preferred embodiment of the present disclosure comprises an upper layer 21 and a lower layer 22. Each of the upper and lower layers 21 and 22 is internally coated with an adhesive and airtight thermoplastic polyurethane (TPU) film and is thermally sealed along its peripheral edges. A plurality of internal baffles 23, formed of TPU or other polymeric materials, is thermally bonded between the upper and lower layers 21 and 22 with two end of the internal baffles 23 and arranged in parallel, thereby defining a series of parallel and interconnected air channels 24. A thermal insulation material 25 is disposed above and below within each of the air channels 24. The thermal insulation material 25 comprises a polyethylene terephthalate (PET) film laminated with a synthetic cotton 252 and coated with an electroplated aluminum film 251. The aluminum-coated PET layers 251 are arranged facing the interior of the air channels 24, creating a radiant refraction effect between them that can enhance the reflection of thermal radiation. An upper surface of the synthetic cotton 252 is thermally fused to the TPU films of each of the upper and lower layers 21, 22 to form two fused segments 26 and 27 per layer, with the fused segments 26 and 27 arranged in parallel with the internal baffles 23. A maximum edge-to-edge distance between the two fused segments 26 and 27 is configured to be equal to or slightly less than the maximum width of the free side edges 253 and 254 of the thermal insulation material 25.

Figure 9:
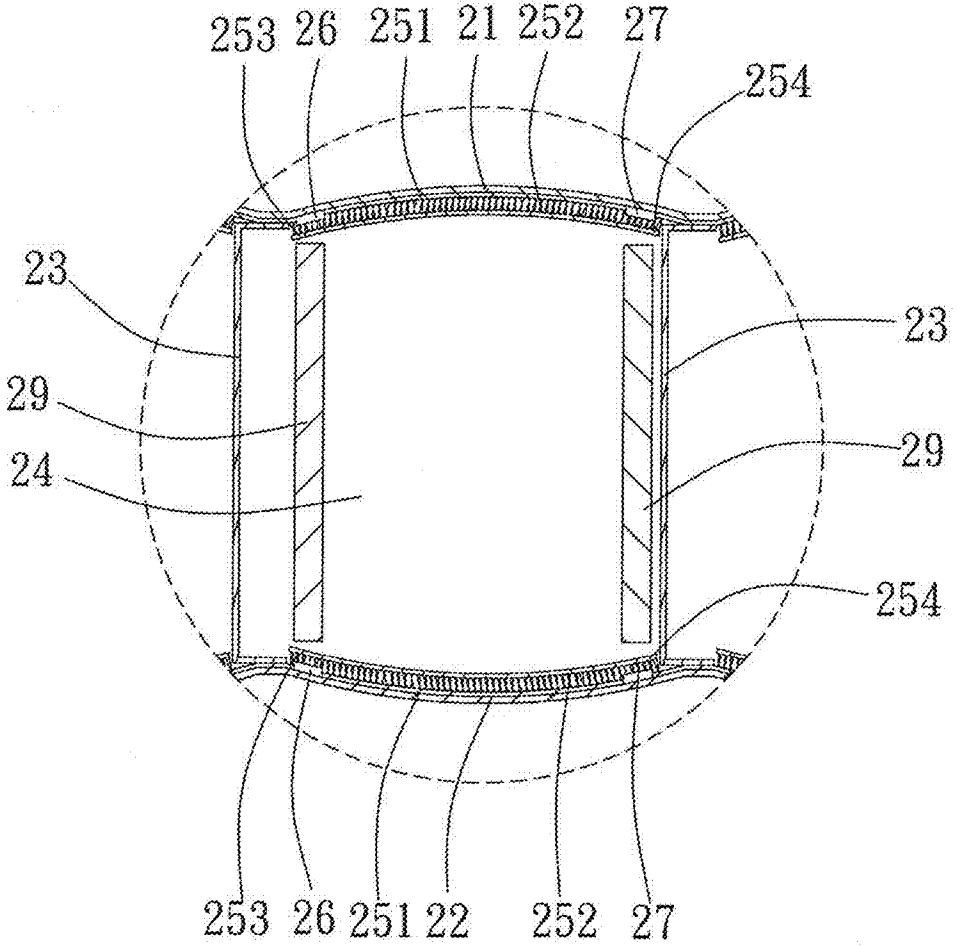
FIG. 9 is a cross-sectional view of the manufacturing process of the present disclosure.

As illustrated in FIG. 9, during the manufacturing process for forming the fused segments 26 and 27 thermally fused with synthetic cotton 252, an alignment fixture 29 is inserted into each of the air channels 24 at positions corresponding to the fused segments 26 and 27. This alignment fixture 29 serves to prevent thermal interference with the internal baffles 23 during the fusion process, as the internal baffles 23, being made of thermoplastic materials, may melt or deform when exposed to high temperatures.

When air is introduced into the inflatable mattress 20 via an air valve 28, the air circulates through the air channels 24, inflating the mattress. The thermal insulation material 25, secured in position by the fused segments 26 and 27, moves together with the displacement of the upper and lower layers 21, 22. This configuration prevents the free edges 253 and 254 of the thermal insulation material 25 from bending inward, thereby maintaining the flat configuration of the thermal insulation material 25 during inflation. Similarly, during deflation and folding for storage, the free edges 253 and 254 remain constrained in position, preventing inward deflection and ensuring that the thermal insulation material 25 lies flat for subsequent reinflation and reuse.

Figure 10:
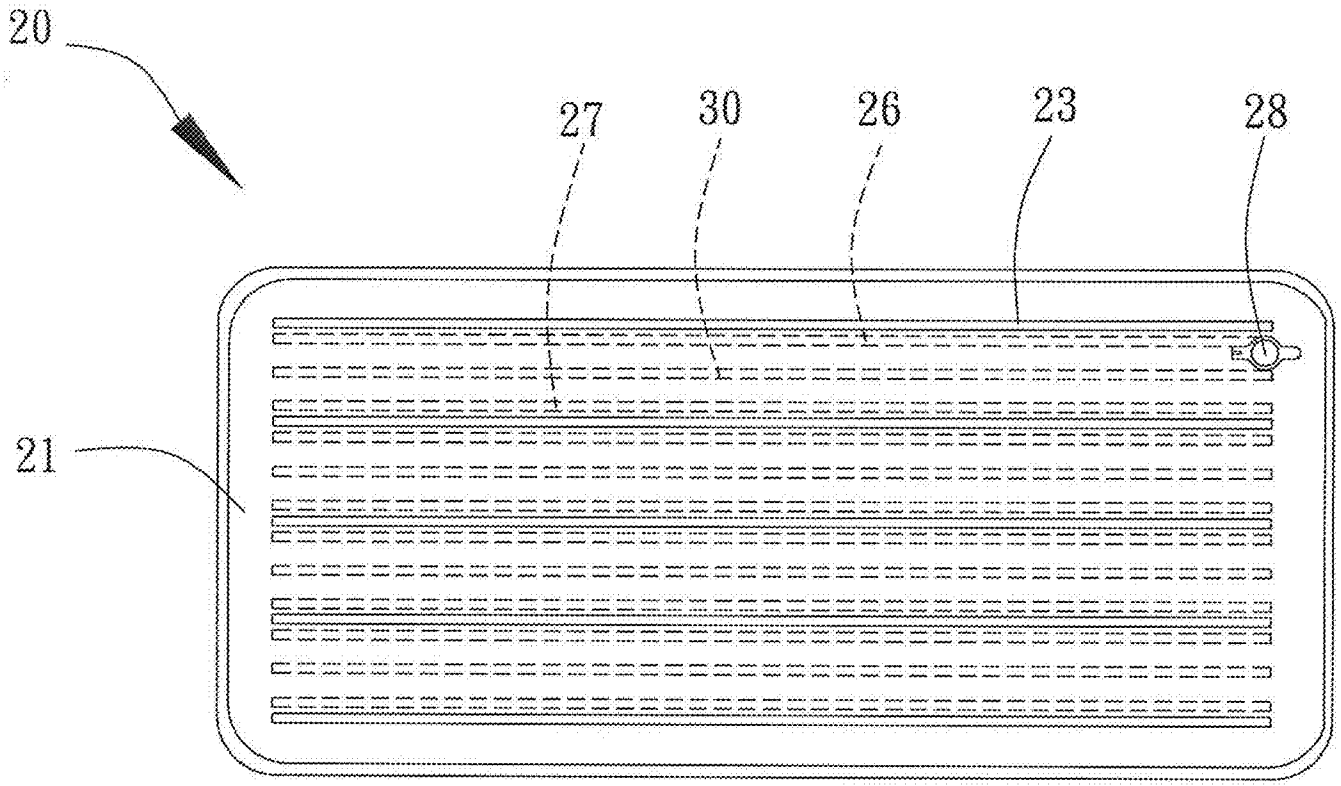
FIG. 10 is a plan view of a first preferred embodiment of the present disclosure.

Referring to FIG. 10, which illustrates a first preferred embodiment of the present disclosure, the upper surface of the synthetic cotton 252 is thermally fused to the TPU films of each of the upper and lower layers 21 and 22 to form two or more fused segments 26, 27, and 30.

Figure 11:
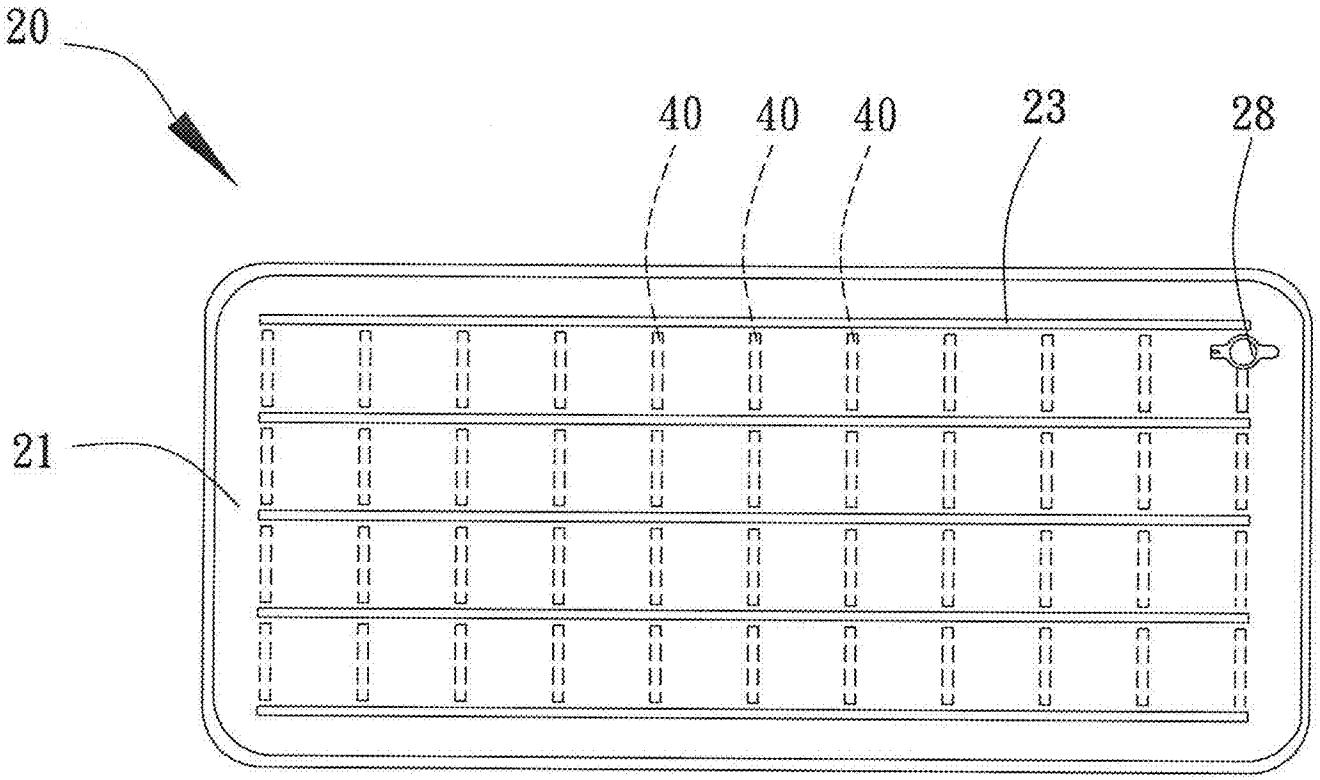
FIG. 11 is a plan view of a second preferred embodiment of the present disclosure.

Referring to FIG. 11, which illustrates a second preferred embodiment, the upper surface of the synthetic cotton 252 is thermally fused to the TPU films of each of the upper and lower layers 21 and 22 to form a plurality of fused segments 40. The fused segments 40 are arranged perpendicular to the internal baffles 23. A maximum width of each of the fused segments 40 is configured to be equal to or slightly less than a maximum width of the opposing free edges 253 and 254 of the thermal insulation material 25.

Figure 12:
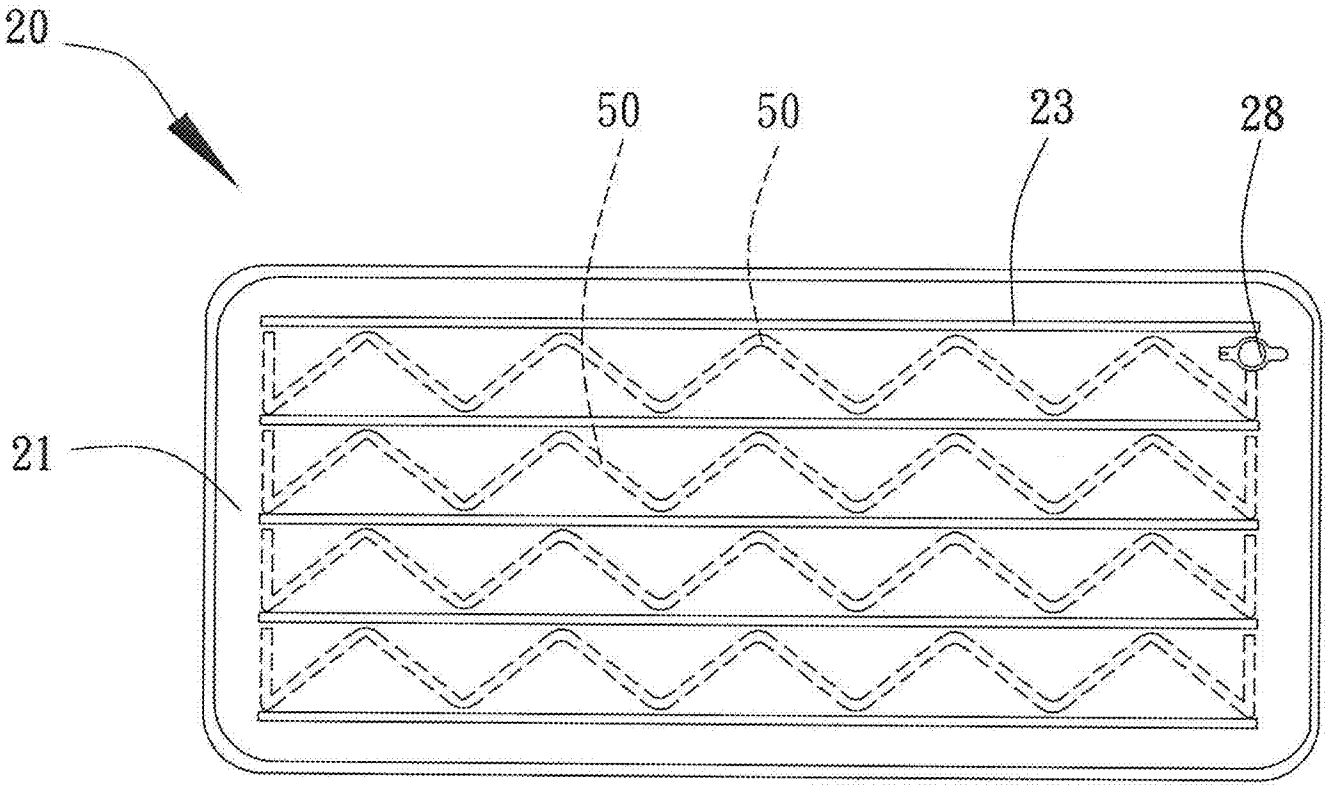
FIG. 12 is a plan view of a third preferred embodiment of the present disclosure.

Referring to FIG. 12, which illustrates a third preferred embodiment, the upper surface of the synthetic cotton 252 is thermally fused to the TPU films of each of the upper and lower layers 21 and 22 to form one or more fused segments 50 having arcuate or other geometric shapes. The fused segments 50 are disposed between adjacent internal baffles 23. A maximum width of each of the fused segments 50 is configured to be equal to or slightly less than a maximum width of the opposing free edges 253 and 254 of the thermal insulation material 25.

The foregoing descriptions relate to preferred embodiments of the present disclosure. However, various modifications and equivalent substitutions may be made by those skilled in the art without departing from the spirit and scope of the disclosure, which is defined solely by the appended claims.

What is claimed is:

1. An inflatable mattress structure, comprising:

an upper layer and a lower layer, each internally coated with an adhesive and airtight thermoplastic polyurethane (TPU) film and sealed along their peripheries;

a plurality of internal baffles disposed between the upper layer and the lower layer, the internal baffles being bonded thereto and arranged in parallel to define a series of parallel and interconnected air channels; and a thermal insulation material disposed above and below within each of the air channels, the thermal insulation material comprising a polyethylene terephthalate (PET) film laminated with a synthetic cotton and coated with an electroplated aluminum film;

wherein an upper surface of the synthetic cotton is thermally fused to the TPU films of each of the upper and lower layers to form a plurality of fused segments per layer.

2. The inflatable mattress structure according to claim 1, wherein the fused segments are arranged parallel to the internal baffles.

3. The inflatable mattress structure according to claim 2, wherein a maximum edge-to-edge distance between two fused segments is equal to or slightly less than a maximum width of opposing free edges of the thermal insulation material.

4. The inflatable mattress structure according to claim 1, wherein the plurality of fused segments comprises two or more fused segments.

5. The inflatable mattress structure according to claim 1, further comprising an alignment fixture disposed within the air channels at positions corresponding to the fused segments.

6. The inflatable mattress structure according to claim 1, wherein the fused segments are arranged perpendicular to the internal baffles.

7. The inflatable mattress structure according to claim 6, wherein a maximum width of each of the fused segments is equal to or slightly less than a maximum width of opposing free edges of the thermal insulation material.

8. The inflatable mattress structure according to claim 1, wherein the fused segments are arcuate or geometric in shape and disposed between adjacent internal baffles.

9. The inflatable mattress structure according to claim 8, wherein a maximum width of the fused segment is equal to or slightly less than a maximum width of opposing free edges of the thermal insulation material.

* * * * *